US011434640B1

(12) United States Patent
Abbott

(10) Patent No.: US 11,434,640 B1
(45) Date of Patent: Sep. 6, 2022

(54) PIPE GUARD DEVICE AND METHOD OF USE

(71) Applicant: Timothy Michael Abbott, Spring, TX (US)

(72) Inventor: Timothy Michael Abbott, Spring, TX (US)

( * ) Notice: Subject to any disclaimer, the term of this patent is extended or adjusted under 35 U.S.C. 154(b) by 0 days.

(21) Appl. No.: 17/178,065

(22) Filed: Feb. 17, 2021

Related U.S. Application Data

(60) Provisional application No. 63/127,006, filed on Dec. 17, 2020.

(51) Int. Cl.
*E04D 13/147* (2006.01)

(52) U.S. Cl.
CPC ..... *E04D 13/1476* (2013.01)

(58) Field of Classification Search
CPC ..... E04D 13/1476; E04D 13/147
See application file for complete search history.

(56) References Cited

U.S. PATENT DOCUMENTS 5,226,263 A * 7/1993 Merrin ..... E04D 13/1476 285/42
5,333,419 A * 8/1994 Hickner ..... E04D 13/04 52/13
6,070,370 A * 6/2000 Locke ..... E04D 13/1407 52/287.1
7,568,314 B2 * 8/2009 Collins ..... H02G 3/22 52/219
8,628,286 B2 * 1/2014 Duvekot ..... F16B 33/004 411/369
9,140,002 B2 * 9/2015 Coscarella ..... E04B 1/625
10,018,287 B2 * 7/2018 Coscarella ..... H02G 3/22
10,711,923 B2 * 7/2020 Haynes ..... F16L 5/10
10,787,804 B2 * 9/2020 Coscarella ..... E04B 1/665
2006/0027388 A1 * 2/2006 Collins ..... F16L 5/02 174/663
2007/0245894 A1 * 10/2007 Poulis ..... F16L 5/12 96/4
2008/0060289 A1 * 3/2008 Shah ..... E06B 1/62 52/204.53
2008/0157518 A1 * 7/2008 Cecilio ..... E02D 31/02 285/42
2008/0290070 A1 * 11/2008 Fleming ..... E04D 13/1476 219/61
2011/0094652 A1 * 4/2011 Duvekot ..... E04D 13/1476 156/60
2013/0231042 A1 * 9/2013 Coscarella ..... F24F 7/00 454/339
2013/0234404 A1 * 9/2013 Coscarella ..... F16L 5/02 277/606
2014/0260044 A1 * 9/2014 Gilleran ..... E04D 13/1476 52/506.1

(Continued)

FOREIGN PATENT DOCUMENTS

WO WO-0123686 A1 * 4/2001 ..... E04D 13/1476

*Primary Examiner* — Rodney Mintz
(74) *Attorney, Agent, or Firm* — Leavitt Eldredge Law Firm

(57) ABSTRACT

A pipe guard system for preventing damage of piping equipment such as pipe jacks, vent pipes, and the like from environmental elements in roof construction comprising a body member having a top portion, bottom portion, one or more side walls; and a ring configured with an opening to allow the insertion of a pipe jack therethrough.

1 Claim, 4 Drawing Sheets

(56) References Cited

U.S. PATENT DOCUMENTS

| | | | | |
|---|---|---|---|---|
| 2015/0218798 | A1* | 8/2015 | Coscarella | F16L 5/10<br>52/741.3 |
| 2015/0323103 | A1* | 11/2015 | Coscarella | H02G 3/22<br>277/314 |
| 2018/0209205 | A1* | 7/2018 | Gilleran | E06B 1/62 |
| 2018/0209564 | A1* | 7/2018 | Gilleran | F16L 5/10 |
| 2019/0017257 | A1* | 1/2019 | Coscarella | F16L 5/10 |
| 2019/0093795 | A1* | 3/2019 | Haynes | F16L 5/02 |
| 2021/0148489 | A1* | 5/2021 | Gilstrap | F16L 5/14 |

* cited by examiner

PIPE GUARD DEVICE AND METHOD OF USE

BACKGROUND

1. Field of the Invention

The present invention relates generally to pipe guards, and more specifically to a pipe guard for roof construction.

2. Description of Related Art

Pipe guards are well known in the art and are effective means for protecting pipes against environmental damage. Commonly in the art, pipe guards utilize roof flashings to prevent water seepage around vent pipes (also referred to as pipe jacks, roof jacks, pipe collars, or pipe boots) on roofs. For example, FIG. 1 depicts a conventional roof flashing 101 having a base 103 configured with an opening 105 to allow a vent pipe (not shown) to be inserted therein. The base 103 is secured on top of a roof 107 using a plurality of fastening attachments 109.

One of the problems commonly associated with conventional roof flashings is limited durability. Roof flashings are generally made of metal strips and can corrode over time due to environmental effects such as water, sunlight, insects, debris, etc. Moreover, roof flashing installation is difficult and tedious which can lead to an increase chance of improper installment. Hence, it would be desirable and advantageous to provide for a device that is easy to install and effectively protects piping equipment in roof construction from environmental effects.

Accordingly, although great strides have been made in the area of pipe guards, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
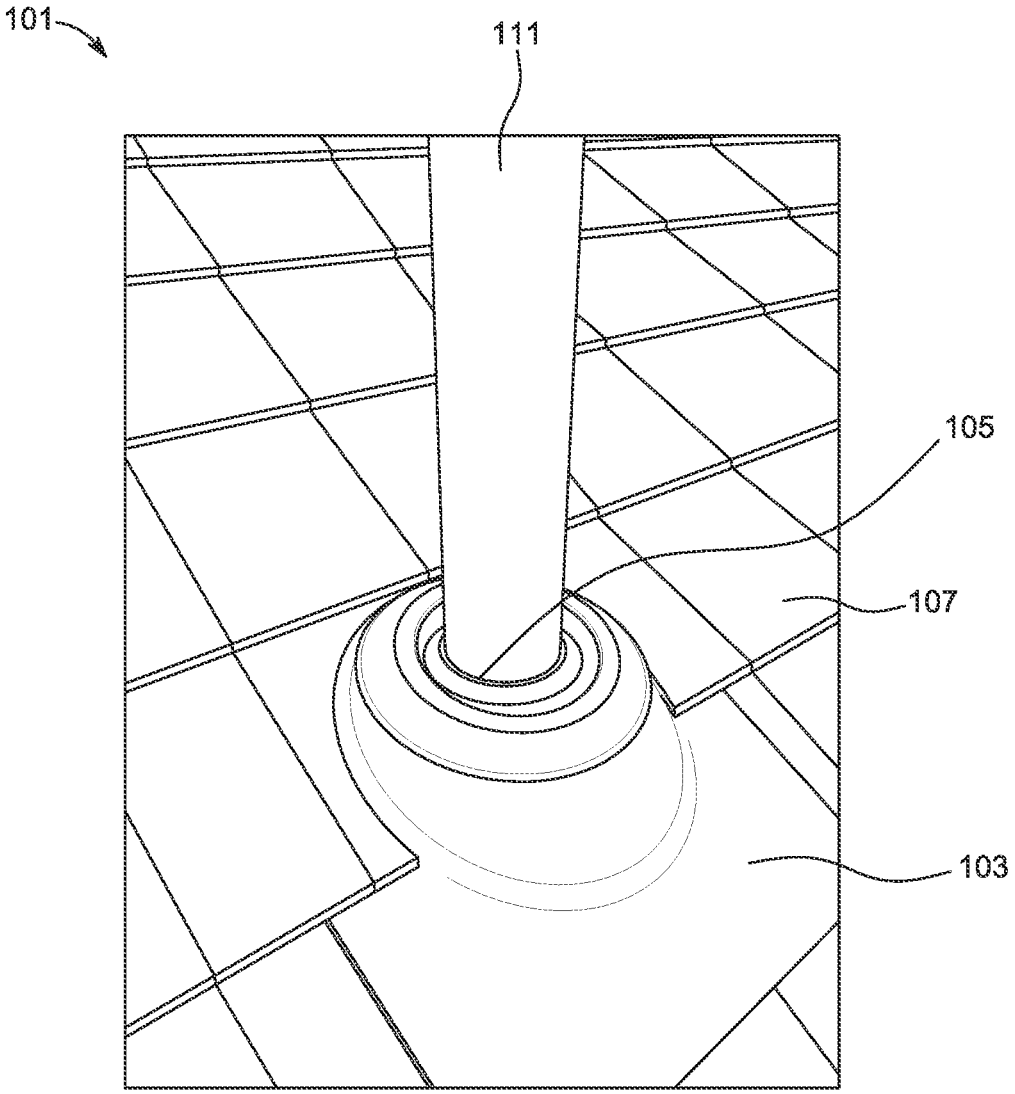
FIG. 1 (Prior Art)
FIG. 1 is a front view of a conventional roof flashing.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional pipe guards. Specifically, the present invention extends the longevity of piping equipment in roof construction. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
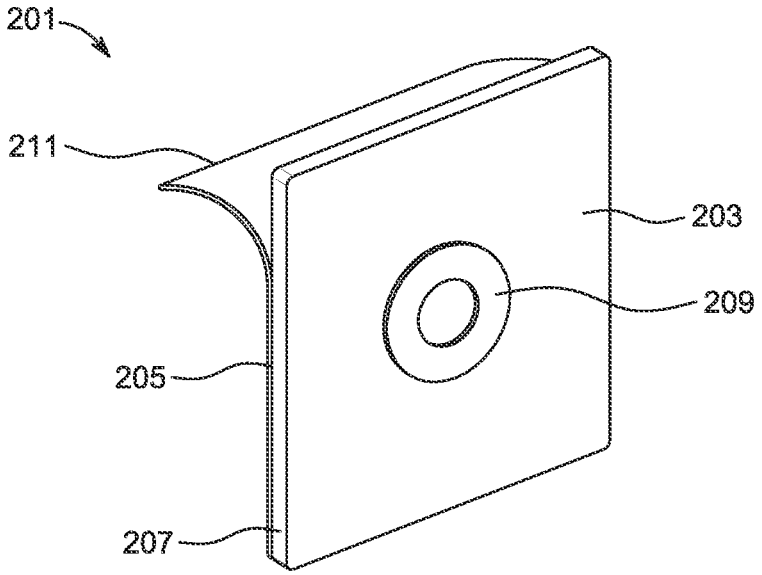
FIG. 2. is a perspective view of a pipe guard device in accordance with a preferred embodiment of the present invention.

Referring now to the drawings wherein like reference characters identify corresponding or similar elements throughout the several views, FIG. 2 depicts a perspective view of a pipe guard device in accordance with a preferred embodiment of the present application. It will be appreciated that the pipe guard device 201 overcomes one or more of the above-listed problems commonly associated with conventional pipe guards. It should also be appreciated that the pipe guard device 201 can vary based on aesthetical, functional, or manufacturing considerations.

In the contemplated embodiment, the pipe guard device 201 comprises of a body member having a top portion 203, a bottom portion 205, and one or more side walls 207. The top portion 203 couples to the bottom portion 205 via the one or more side walls 207. The bottom portion 205 also includes an adhesive film 211 configured to peel off prior to installation of the pipe guard device 201.

It should be appreciated that although the pipe guard device 201 is shown having a rectangular configuration, it is contemplated that the pipe guard device 201 can be in any suitable configuration such as circular, oval, triangular, square, and the like. In addition, it should be appreciated that the top portion 203, the bottom portion 205, and the one or more side walls 207 are made of preferably fiberglass or other suitable material.

The pipe guard device 201 further includes a ring 209 configured with an opening to allow for the insertion of a vent pipe 309 (not shown, see FIG. 3) therethrough. It should be appreciated that the ring is 209 reinforced with preferably rubber material (e.g., natural and/or synthetic) or other suitable material. In addition, it should be appreciated that although the ring 209 is shown in the central part of the pipe guard device 201, it is contemplated that the ring 209 could vary in location, size, style, and the like.

During use, a user may peel back the adhesive film 211, exposing the adhesive backing of the bottom portion 205. The adhesive backing of the bottom portion 205 allows the pipe guard device 201 to securely couple to a roof surface for easy installation. The user can then proceed to add any roofing materials over the pipe guard device 201 to complete the desired roof aesthetic. Examples of roofing materials include, without limitation, shingles (e.g., metal, wood, synthetic, etc.), tile (e.g., clay, concrete, slate, etc.), membrane (e.g., neoprene, ethylene propylene diene monomer, polyvinyl chloride, etc.), built-up roofing, rolled roofing, and the like.

It should also be appreciated that one of the unique features believed characteristic of the present application is the configuration of the pipe guard device 201 that protects piping equipment in roof construction against environmental elements, thereby extending the longevity of the piping equipment.

Figure 3:
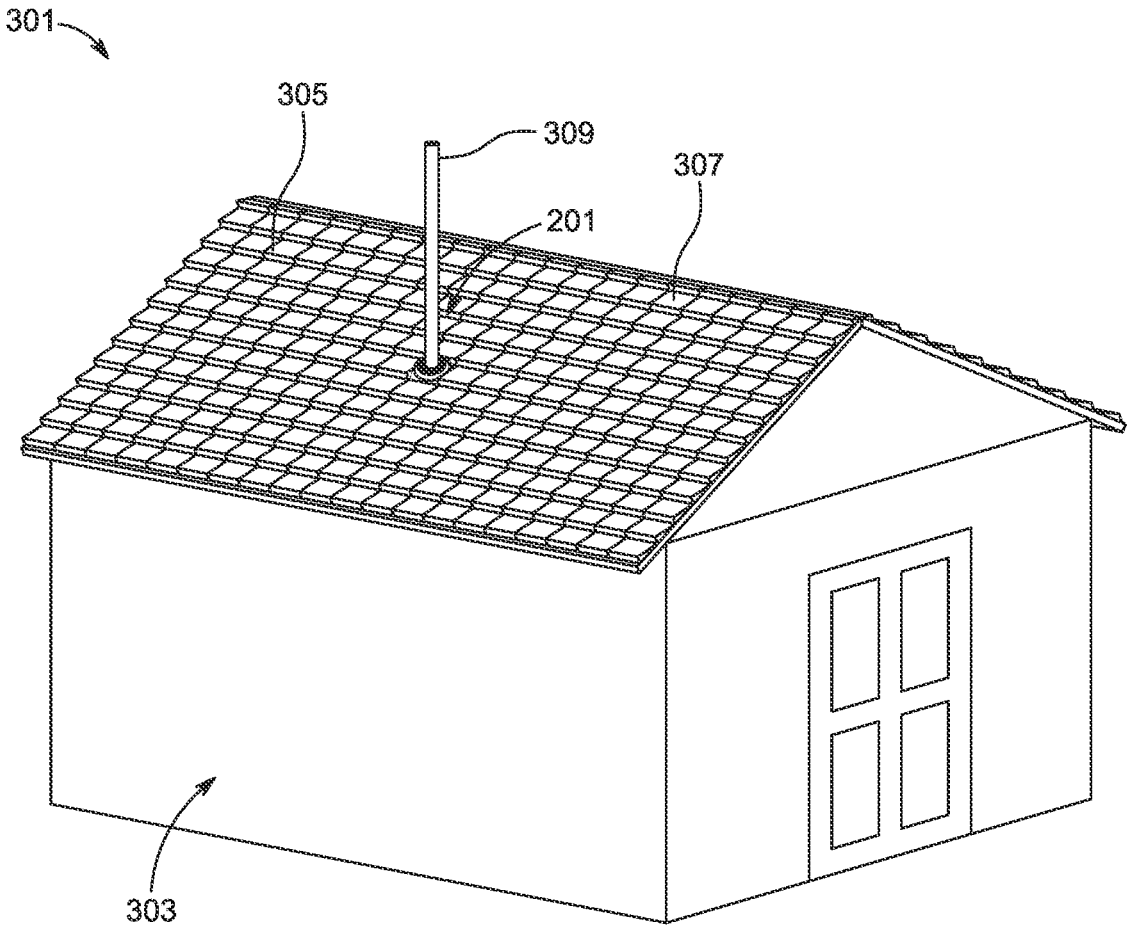
FIG. 3 is a perspective view of the pipe guard device of FIG. 2 in a building in accordance with one or more embodiments of the present application.

In FIG. 3, a perspective view of the pipe guard device 201 in a building 303 is depicted. As shown, the building 303 includes a roof 305 with shingles 307 and a vent pipe 309. The vent pipe 309 inserts through the ring 209 (not shown) of the pipe guard device 201. The shingles 307 cover the body member of the pipe guard device 201, leaving only the vent pipe 309 exposed.

Figure 4:
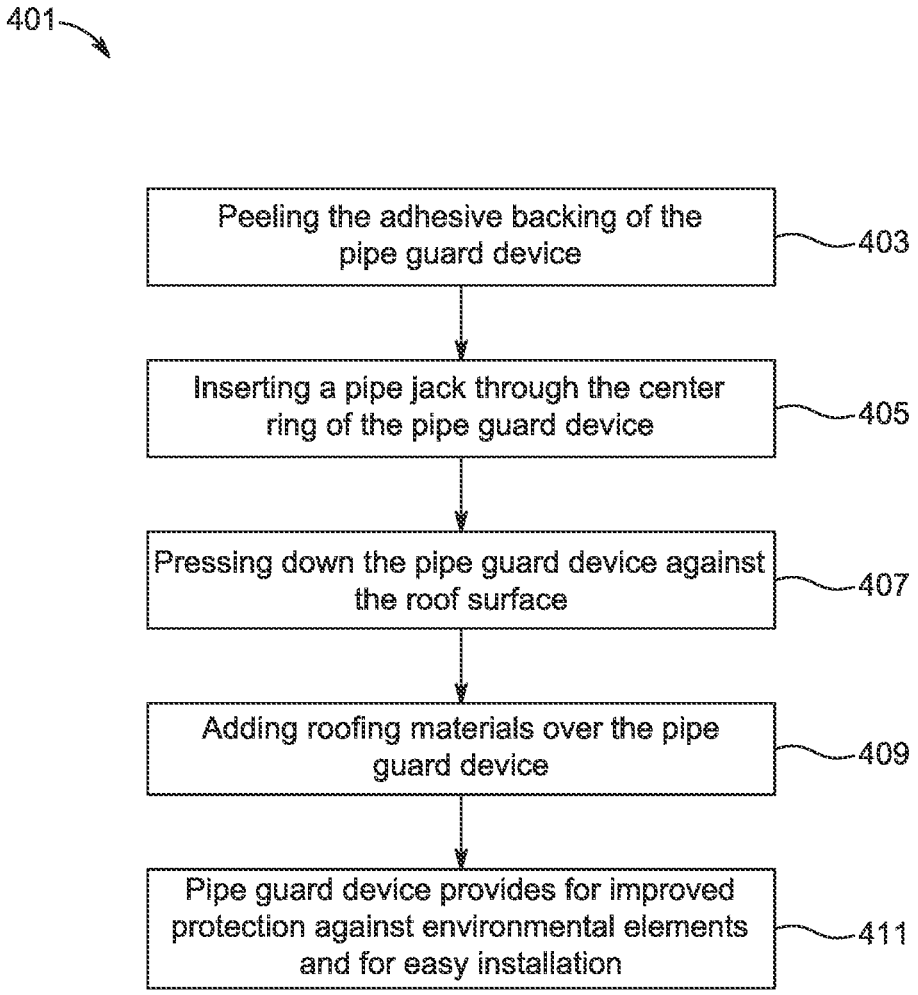
FIG. 4 is a flowchart of a method of use of the pipe guard device of FIG. 2.

In FIG. 4, a flowchart 401 depicts a simplified method of use associated with the pipe guard device 201. During use, when the adhesive backing of the pipe guard device is peeled back, a pipe jack can insert through the center ring of the pipe guard device, as shown with boxes 403, 405. The user can then press down onto the pipe guard device against the roof surface, as shown with box 407. The user can also add roofing materials over the pipe guard to complete the desired roof aesthetic, as shown with box 409. The pipe guard device provides for improved protection against environmental elements and for easy installation, as shown with box 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A pipe guard, consisting essentially of:

a square body member, the square body member having:
- a top portion;
- a bottom portion;
- one or more side walls; and
- a center aperture penetrating through the body member;

wherein the body member is composed of a fiberglass material;

an adhesive backing secured to the bottom portion;

a peelable adhesive film removably secured to the adhesive backing; and a ring coextensively positioned around the center aperture of the body member and coupled to the top portion of the body member, the ring is composed of a rubber material and defines a central opening that is configured to allow a pipe jack to insert therethrough such that only the ring contacts the pipe jack;

wherein the adhesive backing is configured to securely couple to a roof surface.

* * * * *